US006118854A

United States Patent [19]

Solomon et al.

[11] Patent Number: 6,118,854

[45] Date of Patent: Sep. 12, 2000

[54] METHOD OF MAKING X-RAY BEAM HARDENING FILTER AND ASSEMBLY

[75] Inventors: Edward G. Solomon, Menlo Park; Giovanni Pastrone, Los Gatos, both of Calif.

[73] Assignee: Cardiac Mariners, Inc., Los Gatos, Calif.

[21] Appl. No.: 09/167,638

[22] Filed: Oct. 6, 1998

[51] Int. Cl.[7] ..... G21K 3/00

[52] U.S. Cl. ..... 378/156; 378/158

[58] Field of Search ..... 378/156, 145, 378/159, 158

[56] References Cited

U.S. PATENT DOCUMENTS

| | | | |
|---|---|---|---|
| 2,638,554 | 5/1953 | Bartow et al. | 250/99 |
| 2,825,817 | 3/1958 | North | 250/105 |
| 2,837,657 | 6/1958 | Craig et al. | 250/65 |
| 3,106,640 | 10/1963 | Oldendorf | 250/52 |
| 3,591,806 | 7/1971 | Brill et al. | 250/71.5 |
| 3,778,614 | 12/1973 | Hounsfield | 250/362 |
| 3,780,291 | 12/1973 | Stein et al. | 250/36.3 |
| 3,925,660 | 12/1975 | Albert | 250/272 |
| 3,936,639 | 2/1976 | Barrett | 250/369 |
| 3,944,833 | 3/1976 | Housfield | 250/367 |
| 3,949,229 | 4/1976 | Albert | 250/401 |
| 3,950,613 | 4/1976 | Macovski | 378/2 |
| 3,979,594 | 9/1976 | Anger | 250/369 |
| 3,983,397 | 9/1976 | Albert | 250/406 |
| 3,995,164 | 11/1976 | Ramsay et al. | 378/156 |
| 4,017,730 | 4/1977 | Barrett | 250/363 |
| 4,048,496 | 9/1977 | Albert | 250/272 |
| 4,057,745 | 11/1977 | Albert | 313/55 |
| 4,096,391 | 6/1978 | Barnes | 378/146 |
| 4,144,457 | 3/1979 | Albert | 250/445 |
| 4,196,351 | 4/1980 | Albert | 250/416 |
| 4,259,583 | 3/1981 | Albert | 250/416 |
| 4,260,885 | 4/1981 | Albert | 250/277 |
| 4,288,697 | 9/1981 | Albert | 250/505 |
| 4,321,473 | 3/1982 | Albert | 250/505 |
| 4,323,779 | 4/1982 | Albert | 250/401 |
| 4,393,127 | 7/1983 | Greschner et al. | 378/161 |
| 4,465,540 | 8/1984 | Albert | 156/252 |
| 4,519,092 | 5/1985 | Albert | 378/45 |
| 4,688,242 | 8/1987 | Ema | 378/154 |
| 5,285,489 | 2/1994 | Ohtsuchi et al. | 378/156 |
| 5,293,417 | 3/1994 | Wei et al. | 378/147 |
| 5,303,282 | 4/1994 | Kwasnick et al. | 378/147 |
| 5,550,378 | 8/1996 | Skillicorn et al. | 250/357 |
| 5,610,967 | 3/1997 | Moorman et al. | 378/154 |
| 5,886,354 | 3/1999 | Leblans | 250/484.4 |

FOREIGN PATENT DOCUMENTS

| | | | |
|---|---|---|---|
| WO 94/23458 | 10/1994 | WIPO | H01L 31/115 |
| WO 96/25024 | 8/1996 | WIPO | H05J 35/00 |

OTHER PUBLICATIONS

Currey et al., *Christensen's Physics of Diagnostic Radiology,* Fourth Edition, Lea & Febiger, 1990, pp. 1–522.

Gray "Application of Optical Instrumentation in Medicine VII", Proceedings of the Society of Photo–Optical Instrumentation Engineers, Mar. 25–27, 1979, vol. 173, pp. 88–97.

*Primary Examiner*—David P. Porta
*Assistant Examiner*—Drew A. Dunn
*Attorney, Agent, or Firm*—Lyon & Lyon LLP

[57] ABSTRACT

An x-ray beam hardening filter and method for making the same is disclosed. According to an embodiment, the method comprises etching a plurality of regularly spaced pits into a surface area of a sheet having an x-ray beam hardening quality, aligning the sheet to a support member and bonding the sheet to the support member. An x-ray beam hardening filter can be made and used which is not only compact and useful in diagnostic x-ray imaging, but which is capable of shaping an x-ray energy spectrum envelope in a highly controllable manner.

9 Claims, 4 Drawing Sheets

METHOD OF MAKING X-RAY BEAM HARDENING FILTER AND ASSEMBLY

BACKGROUND OF THE INVENTION

1. Field of the Invention

This invention pertains to x-ray beam hardening filters and methods for making the same.

2. Background

X-ray sources used in medical imaging are typically polychromatic, that is, the x-ray source produces x-ray photons with varying energies. For example, an x-ray source capable of producing a 120 keV photon will typically produce an x-ray beam having a mean energy of only one-third to one-half of the peak energy. Given that the mean energy is roughly one-half to one-third of the peak energy, many of the photons that comprise an x-ray beam will be characterized by energy levels below the mean energy.

A problem with lower energy photons is that they do not contribute to the construction of the radiographic image. Many of the lower energy photons, for example those with energies less than 20 keV, may be absorbed in the object under investigation; these lower energy photons only contribute to harmful patient radiation. Therefore, it is desirable to filter the lower energy x-ray photons from the x-ray beam.

It is known to use filters to remove lower energy photons from the x-ray beam. One form of filtration is inherent filtration. Inherent filtration results from the absorption of x-ray photons as they pass through the x-ray tube and its housing. Such filtration varies with the composition, or lining of the x-ray tube and housing, as well as the length of the x-ray tube and housing. Inherent filtration, which is measured in aluminum equivalents, typically varies between 0.5 and 1.0 mm aluminum equivalent.

A second form of filtration is added filtration. Added filtration is achieved by placing an x-ray attenuator or filter in the path of the x-ray beam. Most materials have the property of attenuating the lower energy photons more strongly than higher energy photons. When lower energy x-ray beams strike the added filter they are absorbed. By adding a filter to the x-ray beam path, lower energy x-ray photons can be absorbed, thereby reducing the unnecessary radiation created by the lower energy x-ray photons. Because the lower energy x-ray photons are preferentially removed from the x-ray beam, the mean energy of the x-ray beam is increased. Increasing the mean energy of the x-ray beam is referred to as "hardening" of the x-ray beam.

Objects to be x-rayed vary in thickness and composition. Thus, it is desirable to control the amount of filtration that occurs. Some x-ray systems, having a relatively small diameter x-ray source, often use a filter consisting of a thin sheet of aluminum or aluminum and copper. The filter is placed in the path of the x-ray beam, either manually or by an electromechanical actuator. Because of the small diameter of the x-ray source, the filter and filter control mechanism can be made compact.

However, when a large-area x-ray source (e.g., having a diameter of approximately 25 cm or larger) is used in an x-ray imaging system and if added filtration is used, the beam hardening filter inserted into the path of the x-ray beam would be as large as the overall x-ray source in order to cover the entire source. Furthermore, the mechanical travel of the filter to insert it into the path of the x-ray beam would also be about the same as the size of the x-ray source (e.g., 25 cm) or the filter. Using a conventional x-ray hardening filter, for example one that slides in a parallel plane to the surface of the x-ray source, on a large-area x-ray source would involve a large mechanical actuator assembly and would add undesirable bulk to the x-ray imaging system.

SUMMARY OF THE INVENTION

The present invention comprises a method for making a novel x-ray beam hardening filter and assembly, comprising etching a plurality of pits into a sheet having an x-ray hardening quality, aligning the sheet and a support member to a reference point, and bonding the sheet to a support member. In another embodiment, the method further comprises, aligning the plurality of pits with a plurality of collimator apertures, reaming the plurality of pits to a finished size, and removing burs from the support member.

As a result of the method for making the x-ray beam hardening filter disclosed herein, an x-ray beam hardening filter comprising a beam hardening sheet, the beam hardening sheet having a plurality of pits, and a support member can be made and used which is useful in diagnostic x-ray imaging, especially for filtering harmful x-ray radiation which does not contribute to an x-ray image.

BRIEF DESCRIPTION OF THE DRAWINGS

Preferred embodiments of the present invention are illustrated by way of example, and not by way of limitation, in the figures of the accompanying drawings and in which like reference numerals refer to similar elements and in which.

DETAILED DESCRIPTION OF THE PREFERRED EMBODIMENTS

The specification and drawings described in detail herein are related to copending U.S. patent application Ser. Nos. 09/167,639, 09/167,399, filed on the same day herewith, and U.S. Pat. No. 5,610,967, all of which are incorporated herein by reference in their entirety.

Figure 1:
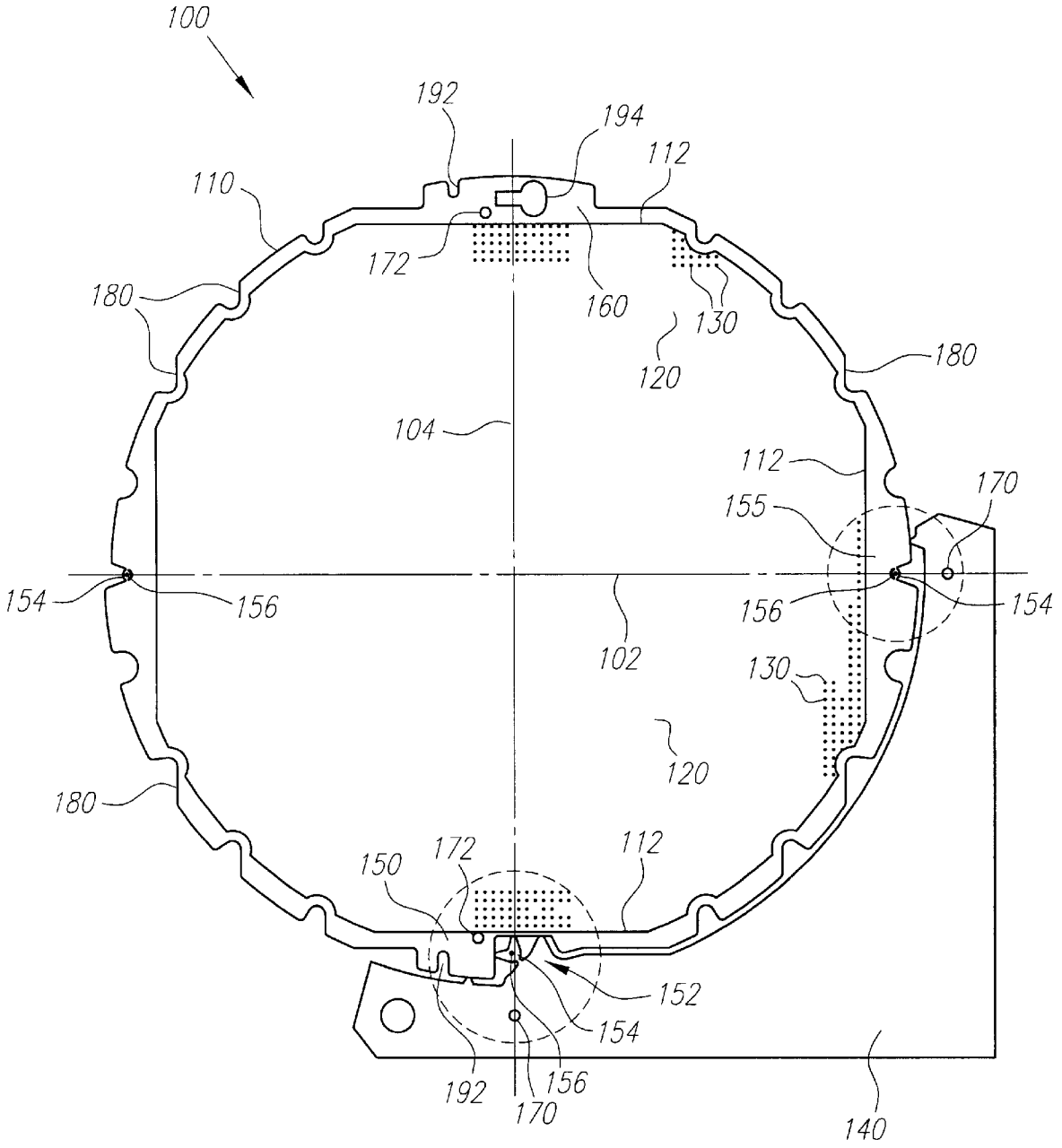
FIG. 1 depicts an x-ray beam hardening filter.

FIG. 1 depicts a preferred construction of an x-ray beam hardening filter 100. The x-ray beam hardening filter 100 comprises a filter plate or "support member" 110, as it is referred to herein, and a sheet having a beam hardening quality. As used herein, the sheet having a beam hardening quality is referred to as a "beam hardening sheet" 120. The beam hardening sheet 120 preferably comprises a plurality of pits. The areas of the beam hardening sheet without pits are configured to cause certain energy levels of x-ray radiation from a polychromatic x-ray beam incident thereon to be absorbed (or filtered), whereas the plurality of pits are configured to not to filter the x-ray radiation. The x-ray beam hardening filter 100 therefore is capable of shaping the energy spectrum envelope of the polychromatic x-ray beam such that certain energy levels of harmful radiation are selectively removed.

The support member 110 is preferably manufactured from stainless steel. Furthermore, the support member 110 is initially larger than washer-shaped article depicted in FIG. 1, for it includes an etching plate 140, which can be removed after bonding a beam hardening sheet 120 to the support member 110, or, later still, after aligning the x-ray beam hardening filter 100 to a collimator assembly.

The outer diameter of the relevant portion of the support member 110 is approximately 10.27 inches, while the inner diameter of the support member 110 is approximately 9.800 inches. The upper and lower portions of the support member 110, that is bottom portion 150 and top portion 160, have a flattened edge 112 extending inward from the outer diameter to a distance 4.512 inches from the x-centerline 102. The side portion 155 also has a flattened portion 112 which extends inward from the outer diameter to a distance of 4.512 inches from the y-centerline 104.

Figure 4:
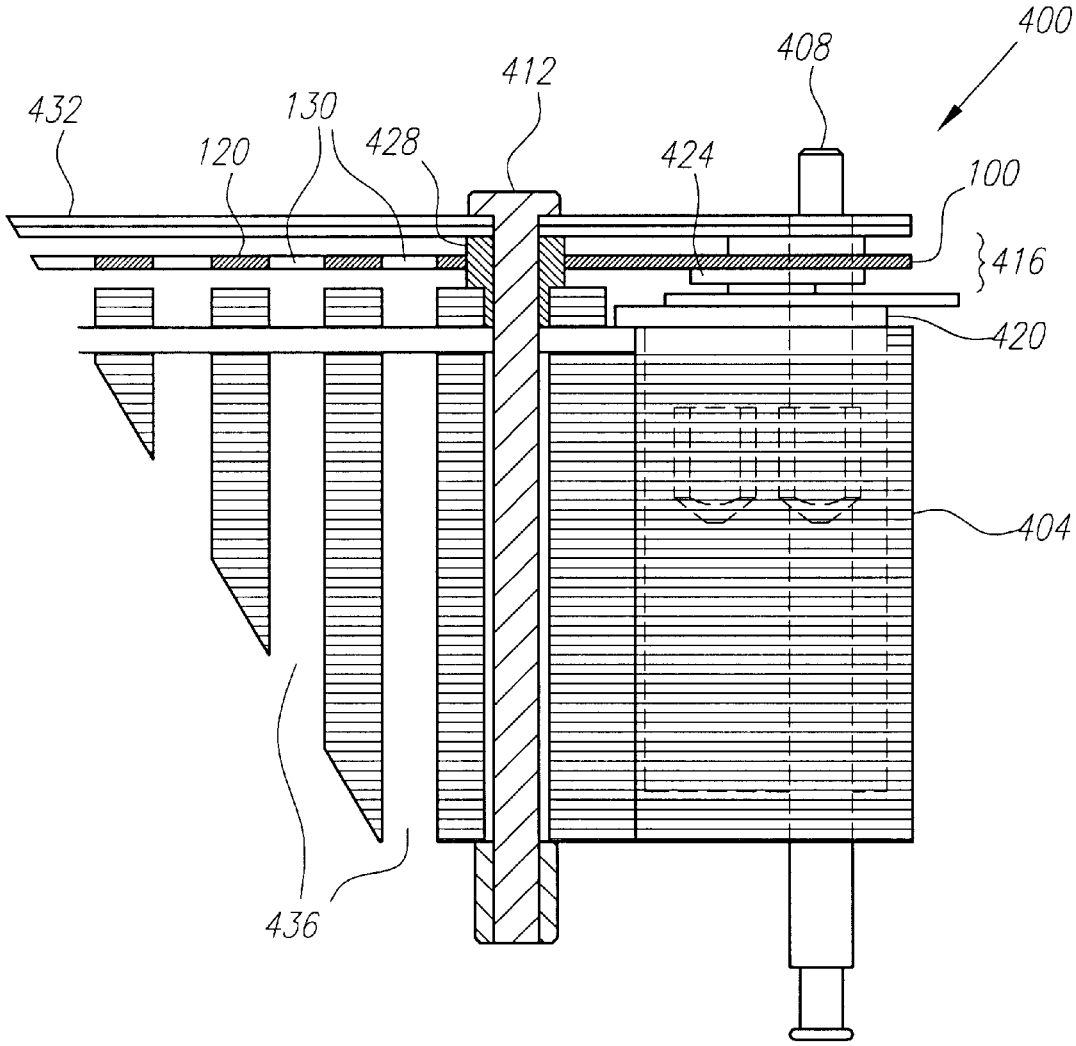
FIG. 4 is cross-sectional view of a collimator assembly having an x-ray beam hardening filter according to an embodiment of the present invention.

The outer edge of the support member 110 is defined by a number of connector openings 180 that permit unobstructed movement of the x-ray beam hardening filter 100 within (or over) a collimator (described in greater detail below with reference to FIG. 4). Both the top and bottom edges, 160 and 150, of the support member 110 comprise direction guides 192 which guide the motion of the support member in straight path. The direction guides 192 have a width of 0.110 inches.

A receiver, or an "actuator aperture" 194, as it is referred to herein, is formed on the top edge 160 of the support member 110. The actuator aperture 194 surrounds an actuator (not shown) which provides a force to move that support member 110 in the straight path defined by direction guides 192. The bottom edge 150 of the support member 110 does not have an actuator aperture 194. The bottom edge 150 instead has a rectangular shaped opening 152. Within the rectangular shaped opening 152 is a break away alignment tab 154. Two additional alignment tabs 154 are also depicted in FIG. 1.

Figure 2:
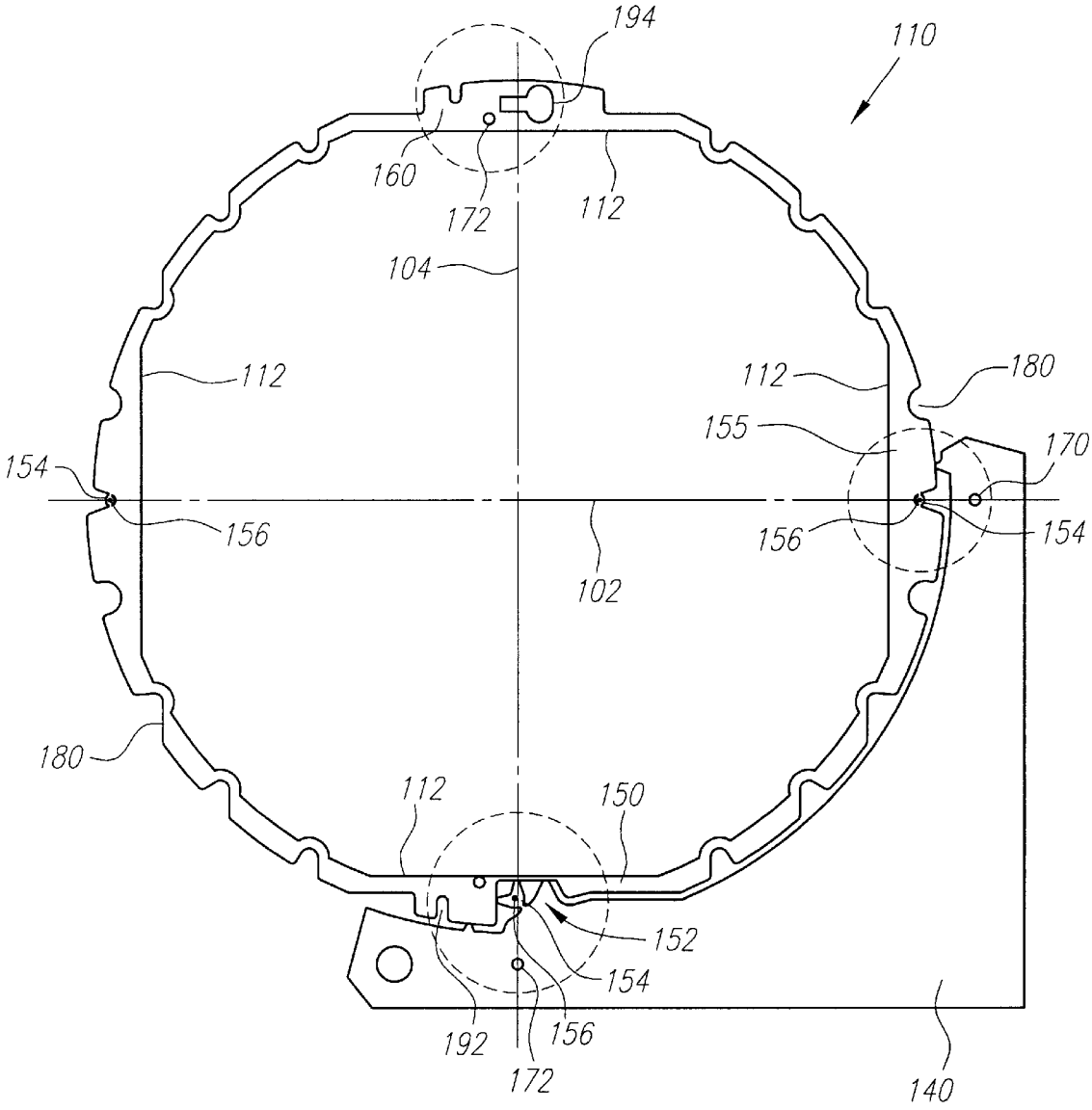
FIG. 2 depicts a support member for an x-ray beam hardening filter.

FIG. 2 depicts the support member 110 without the beam hardening sheet 120.

Figure 3A:
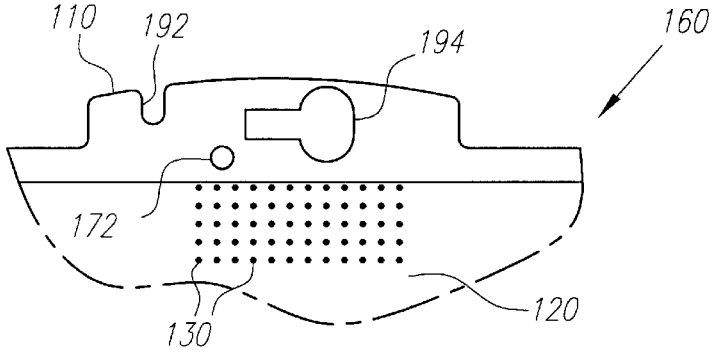
FIG. 3A is a detail schematic of a top portion of a support member.
Figure 3B:
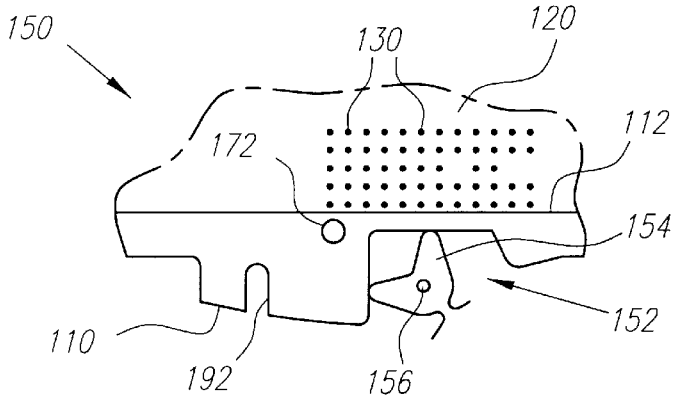
FIG. 3B is a detail schematic of a bottom portion of a support member.

FIG. 3A depicts the top edge 160 of the support member 110, and FIG. 3B depicts the bottom edge 150 of the same. Actuator aperture 194 and alignment slot 172 are depicted in the top edge 160. Alignment slot 172 is 0.110 (±0.002) circular mils. It is preferred that the alignment slot 172 is within 0.002 inches of the true position of the apertures 156 in the break away tabs 154. The actuator aperture 194 preferably has a generally rectangular shape with a height of approximately 0.220 inches, a width of approximately 0.695 inches, and rounded comers with a radius of approximately 0.046 inches. At approximately 0.520 inches from the left side of the rectangle (as depicted in FIG. 3A), near both the top and bottom edges of the rectangle, two circular extensions are carved from the actuator aperture 194. The radius of the two circular extensions is 0.175 inches. The actuator aperture 194 can vary in size and shape, however, it is important that it still allow for movement of an actuator therein, the actuator used to move the beam hardening filter 100 into or out of the path of a polychromatic x-ray beam.

FIG. 3B depicts the bottom edge 150 of the support member 110. The rectangular ledge 152 carved from the support member 110 is begins approximately 0.338 inches from left of the y-centerline 104 and down approximately 4.623 inches from the intersection of the x- and y-centerlines 102 and 104. An alignment tab 154 connects to two sides of the ledge 152. The alignment tab 154 is configured to break away from the support member 110. An alignment aperture 156, measuring 0.047 circular mils, is located on the alignment tab 154. Similar alignment apertures 156 are located on the left and right side of the support member 110 on the x- and y-centerlines 102 and 104.

Figure 3C:
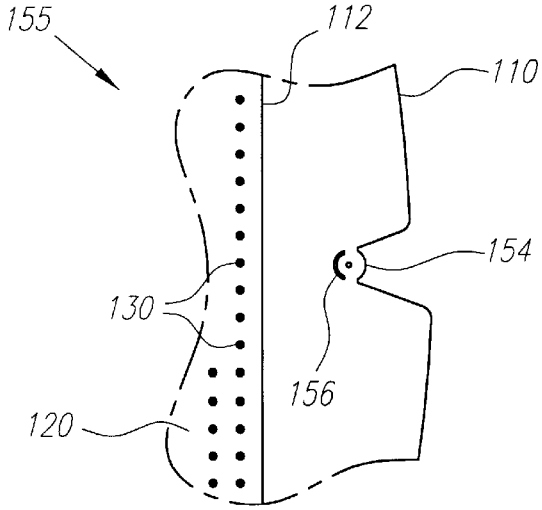
FIG. 3C is a detail schematic of a side portion of a support member.

FIG. 3C depicts a break away tab 154 and alignment aperture 156 which is located on the right side 155 of the support member 110. The break away tab 154 has a radius of 0.100 inches, which is the same as the radius of the alignment tab 154 depicted with reference to FIG. 3B. Again, an alignment aperture 156 is located at the center point of the alignment tab 154.

Returning again to FIG. 1, according to a presently preferred embodiment, a method for making the x-ray beam hardening filter comprises the steps described below. First, a plurality of areas having a different x-ray absorption quality than the beam hardening sheet 120 are chemically etched into the surface of the beryllium (Be) and copper (Cu) beam hardening sheet 120. The result of the etching is a plurality of pits 130 that are regularly spaced about the surface area of the beam hardening sheet 120.

The pits 130 are preferably 0.036 (±0.002) circular mils, and are spaced and shaped according to the parameters defined in Table 1. Furthermore, the pits 130 are symmetrical with the x- and y- centerlines 102 and 104 respectively, with a center of a single pit placed at the intersection of the centerlines 102 and 104. Thus, according to a preferred embodiment, the plurality of pits form a multidimensional array of uniformly sized and spaced pits in the surface area of the beam hardening sheet 120.

TABLE 1

Beam Hardening Filter Pit Spacing (inches & circular mils)

| Sheet Thickness | Reduction Level | Hole Pitch | Hole Size |
|---|---|---|---|
| 0.004 | 0.990636 | 0.89703 | 0.036 (±0.002) |
| 0.008 | 0.990043 | 0.89650 | 0.036 (±0.002) |

An advantage of the present invention is that when uniformly spaced and sized pits 130 are employed, and they are spaced according to Table 1 above, then the movement of the beam hardening sheet need only be a distance approximately equal to one-half the hole pitch, or the spacing between two adjacent pits in the beam hardening sheet. In other embodiments, movement of the beam hardening sheet 120 may follow a curved path and the movement can be restricted to approximately three times the distance between two adjacent areas of equal x-ray absorption. This unique feature allows for a minimal amount of movement of the beam hardening sheet 120 to vary the x-ray absorption quality of the beam hardening filter 100.

In the next step, the support member 110 and the beam hardening sheet 120 are aligned. The alignment is accomplished with the aid of one or more alignment elements. In a preferred embodiment, the beam hardening sheet 120 is first placed on a surface (e.g., a jig) and support member 110 is placed over it. The beam hardening sheet 120 and the support member are aligned to a reference position, namely the alignment slots 170 (having a diameter of 0.125 inches) which are formed into the etching blank 140 and the beam hardening sheet 120.

Once the beam hardening sheet 120 and the support member 110 are aligned, they are bonded together. The bonding step comprises applying a 95% tin and a 5% silver brazing paste between the top of the beam hardening sheet 120 and the bottom of the support member 110, followed by heating the brazing paste to approximately 480 F in a hydrogen atmosphere. Preferably, none of the solder overlaps any of the pits 130. To accomplish this, the brazing paste may be blown from the active area of the sheet before the step of heating with a fan. Furthermore, the beam hardening sheet 120 and support member 110 are clamped together to prevent movement which may cause misalignment before the step of bonding.

It is important not to overheat the brazing paste, and consequently the x-ray beam hardening filter, because there is a chance it will warp. Furthermore, the heating step is preferably performed in a furnace.

According to one embodiment, the x-ray beam hardening filter 100 components (e.g., beam hardening sheet 120 and support member 110) are electroplated before the step of bonding.

Now that the beam hardening sheet 120 has been bonded to the support member 110, another alignment step is performed. Referring to FIG. 4, the x-ray beam hardening filter 100 is placed over a collimator 404 such that the pits 130 align with collimator apertures 436 in the collimator 404. The alignment is facilitated again by alignment slots 170, which can be placed over a jig or alignment pins, alignment slots 172, through which an alignment pin 408 can pass, as well as with the aid of alignment apertures 156 in alignment tabs 154.

Once the pits 130 are aligned, the direction guides 192 are reamed to their preferred size. A final inspection is made of the alignment of the pits 130 with the collimator apertures 436. If alignment is confirmed, then the alignment slots 172 are machined and the etching blank 140 and alignment tabs 154 are removed from the support member 110.

The x-ray beam hardening filter 100 can then be removed from the collimator 404. Burs are preferably ground from the edges of the support member 110. A lubricant is applied to the surfaces of the finished x-ray beam hardening filter 100. According to one embodiment, a dry film lubricant is used. A presently preferred dry film lubricant is Dicronite® made by Dricronite® Dry Lube Northwest, and which is available from CLS, Inc, in Santa Clara, Calif.

Turning again to FIG. 4, one or more x-ray beam hardening filters 416 are placed within a collimator assembly 400. Mounting pins 412 tie the collimator 404 to the collimator cover 432. Spacers, e.g., spacer 428, create a void between the collimator 404 and the collimator cover 432 in which the one or more beam hardening filters 416 can move, aided by an actuator 420 having a cam bearing 424, while pressure is maintained around the collimator cover 432 and collimator 404.

In the foregoing specification, the invention has been described with reference to specific embodiments thereof. It will be evident, however, that various modifications and changes may be made thereto without departing from the broader spirit and scope of the invention. For example, the dimensions and sizes of the various components can be altered and different materials substituted for the construction thereof. Furthermore, the spacing of the pits does not have to be uniform, nor do the pits themselves need to be of a uniform size or shape. The specification and drawings are, accordingly, to be regarded in an illustrative, rather than a restrictive sense.

What is claimed is:

1. A method for making an x-ray beam hardening filter comprising:

etching a plurality of pits into a sheet having an x-ray beam hardening quality;

aligning said sheet with a support member; and bonding said sheet to said support member.

2. The method of claim 1, the step of bonding comprising:

applying an approximately 95% tin and 5% silver brazing paste between said sheet and said support member; and heating said brazing paste in a furnace at approximately 480 F in a hydrogen atmosphere.

3. The method of claim 1, further comprising the steps of:

after said step of bonding, aligning the plurality of pits in said sheet to a plurality of collimator apertures;

reaming one or more direction guides into said support member; and removing burs from said support member.

4. The method of claim 1, wherein said step of etching said plurality of pits of x-ray absorption into said sheet comprises creating a multidimensional array of regularly spaced apertures in a surface area of said sheet.

5. The method of claim 1, said support member comprising stainless steel and said sheet comprising beryllium and copper.

6. The method of claim 1, further comprising coating a surface of said beam hardening filter with a dry film lubricant.

7. The method of claim 1, further comprising electroplating said support member and said sheet before the step of bonding.

8. An x-ray beam hardening filter comprising:

a sheet having an x-ray beam absorption quality, said sheet comprising a plurality of pits disposed on a surface area of said sheet; and a support member having an inner diameter and an outer diameter, said support member bonded to said sheet.

9. The x-ray beam hardening filter of claim 8, wherein said plurality of pits disposed on said surface areas of said sheet are uniformly sized and spaced further apart than a distance equivalent to a smallest opening of one of said plurality of pits.

* * * * *